United States Patent [19]

Solomon

[11] 4,308,987

[45] Jan. 5, 1982

[54] REMAILABLE ENVELOPE

[76] Inventor: Merrill Solomon, 7609 Glackens Dr., Potomac, Md. 20854

[21] Appl. No.: 114,404

[22] Filed: Jan. 22, 1980

[51] Int. Cl.[3] ..... B65D 27/06

[52] U.S. Cl. ..... 229/73; 229/71; 206/610; 206/632; 206/804

[58] Field of Search ..... 229/71, 73, 85; 206/610, 632, 804

[56] References Cited

U.S. PATENT DOCUMENTS

| | | | |
|---|---|---|---|
| 1,145,935 | 7/1915 | Steinke . | |
| 1,870,908 | 8/1932 | Hahn . | |
| 1,888,313 | 11/1932 | Fiorenza . | |
| 1,953,192 | 4/1934 | Rossiter | 229/73 |
| 2,332,751 | 10/1943 | Powell . | |
| 2,828,065 | 3/1958 | Heywood . | |
| 2,931,559 | 4/1960 | Hilliard | 229/73 |
| 3,270,948 | 9/1966 | Donovan . | |
| 3,558,040 | 1/1971 | Krueger . | |
| 3,652,008 | 3/1972 | Grotefend . | |
| 3,874,582 | 4/1975 | Wang | 229/73 |
| 3,942,714 | 3/1976 | Wise | 229/73 |
| 3,982,689 | 9/1976 | Retrum | 229/71 |
| 4,089,418 | 5/1978 | Yahe | 206/632 |
| 4,194,631 | 3/1980 | Rangan . | |

*Primary Examiner*—George T. Hall

*Attorney, Agent, or Firm*—Fleit & Jacobson

[57] ABSTRACT

A remailable envelope formed from an envelope blank which is symmetrical about its center line. The remailable envelope consists of a front panel which may be provided with one or more optional viewing windows and which is integrally connected to a sealable top flap, a pair of opposed side flaps and a back panel; and a resealing flap integrally attached to the back panel. For first mailing, the resealing flap, containing at least two fold lines, is folded within the envelope pocket and mail enclosures are inserted therein. The top flap is then folded to overlie a portion of the back panel and is sealed thereto. Upon receipt by the original addressee, the envelope is opened by removing a tear strip provided in the top flap, enclosures are removed, and the resealing flap is pulled from within the envelope pocket. For second mailing, a response is placed within the envelope pocket and the resealing flap is folded to overlie a portion of the front panel and is sealed thereto.

16 Claims, 10 Drawing Figures

FIG. 1
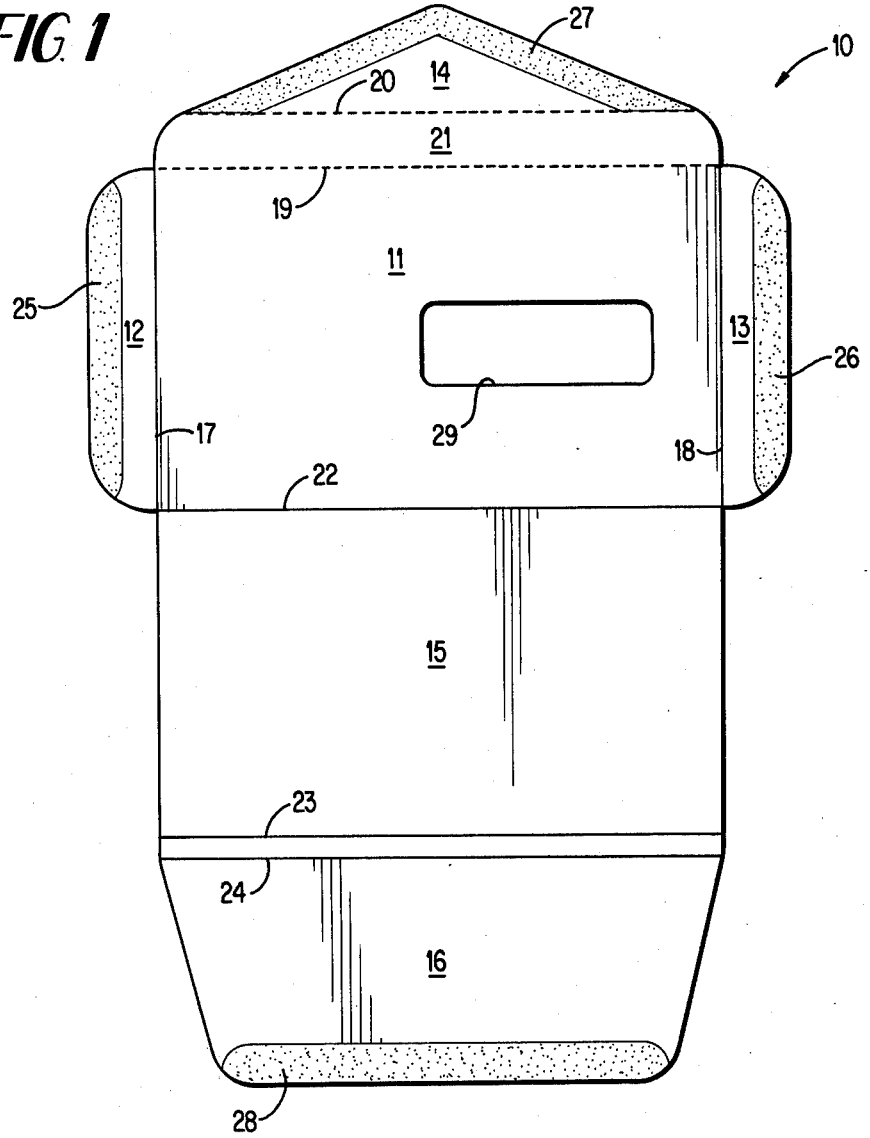
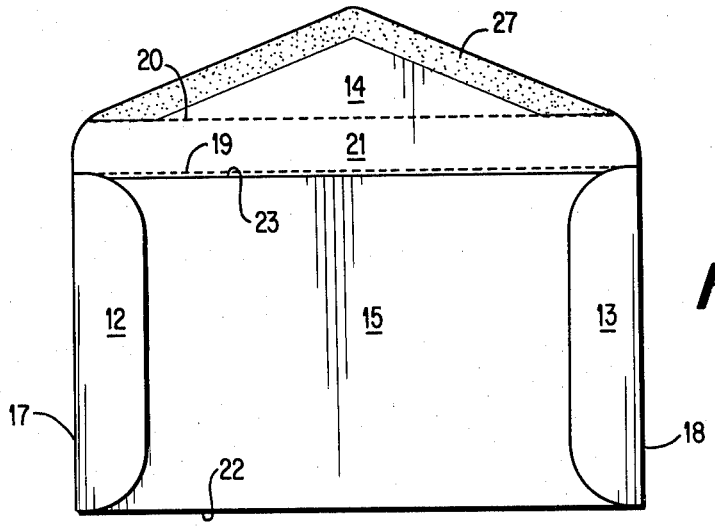
FIG. 2

FIG. 3
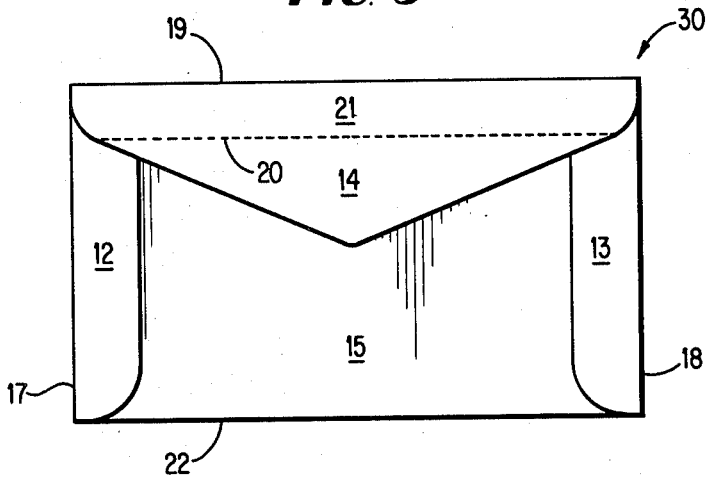
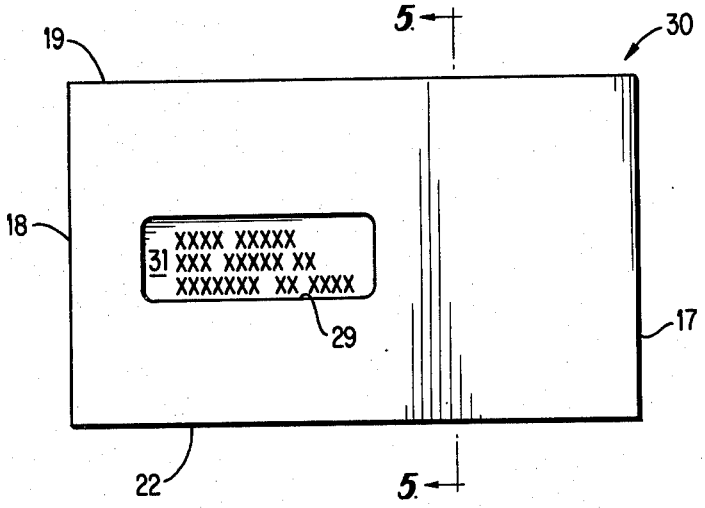
FIG. 4
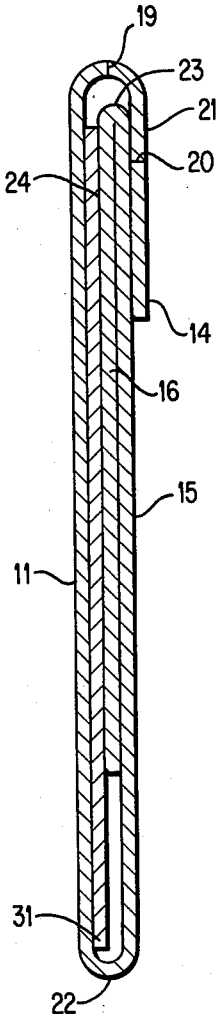
FIG. 5

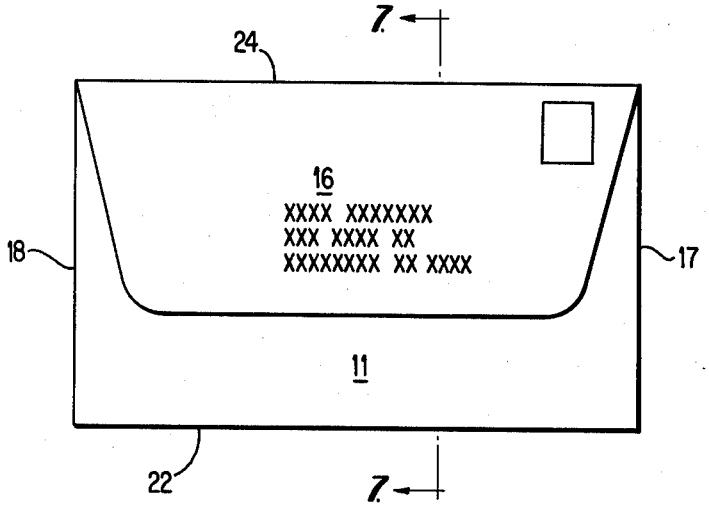
FIG. 6
FIG. 7
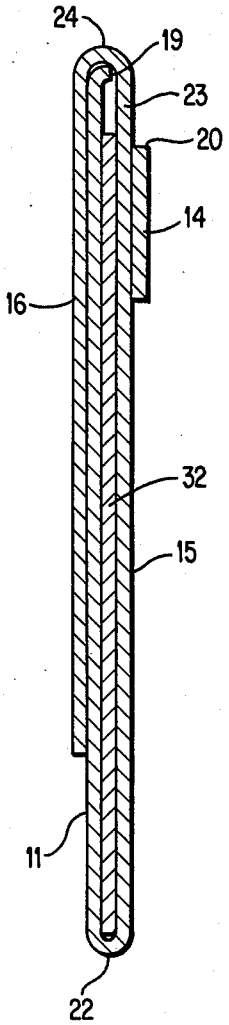
FIG. 8
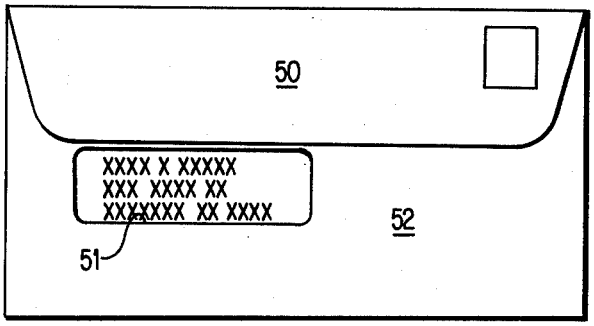

REMAILABLE ENVELOPE

BACKGROUND OF THE INVENTION

1. Field of the Invention

This invention relates to the field of written communications, in general, and to remailable envelopes, in particular.

2. Description of the Prior Art

It is common practice for businesses which solicit mail responses from various addressees to forward material to the addressees in envelopes which contain business material and preaddressed return envelopes. The practice of forwarding return envelopes is also prevalent when bills, such as from credit card or gasoline companies, are sent to customers. The preaddressed return envelope is used by each original addressee to mail the requested response to the original sender. Oftentimes the business mailings are high volume ones and are prepared by high speed automatic techniques which may include envelope blank cutting, printing, folding and sealing, along with automatic insertion steps and automatic addressing operations. Once received by the original addressees, the outer envelopes are opened, either manually or automatically, to expose the contents.

To obviate the need for a separate forwarding envelope and a separate return envelope for each original addressee, it is known to provide remailable or "two-way" envelopes which serve both the forwarding and the return functions. One such known two-way envelope utilizes a resealing flap carried by the back panel of the forwarding envelope, to reseal the envelope for return mailing. Many other designs are known in the patent literature. However, such prior art envelopes have encountered a variety of significant difficulties in manufacture and use. By way of example, many of the prior art envelopes cannot successfully be manufactured on modern, high speed automatic "web-type" envelope making machines, and many do not lend themselves to having enclosures inserted by automatic insertion machines prior to original mailing. Additionally, known two-way envelopes oftentimes require tedious manipulation by the original addressee to prepare the envelope and insertion for remailing thus causing misuse or disuse of the return envelope and/or customer dissatisfaction. Furthermore, the desired remailability of prior art envelopes can be destroyed by the use of automatic or manual envelope openers which may sever the resealing flap from the body of the envelope. There are also two-way envelopes known to the prior art which are designed in such a manner that enclosures cannot be sent in one or both directions of envelope travel.

Examples of prior art envelopes are described in U.S. Pat. Nos. 1,953,192; 2,931,559; 3,874,582; 3,982,689; and 4,089,418. U.S. Pat. No. 1,953,192 discloses a two-way envelope folded from a single asymmetrical envelope blank which has been cut from a sheet of paper. Upon receipt by the original addressee, the envelope is opened by removing a tear strip along the top edge of the envelope, thus reducing the size of the original envelope to a lesser size remailing envelope. For remailing, the original addressee must remove the enclosure from the envelope, reduce the enclosure in size to fit the smaller remailing envelope, properly place the adjusted enclosure in the remailing envelope, and then seal the remailing envelope by folding the resealing flap. A major difficulty with this design is that the asymmetrical blank cannot be processed on conventional "web-type" envelope making machines. Additionally, the two-way mailer requires complicated modifications of the enclosure for return mailing so that the enclosure fits within the smaller remailing envelope, and so that the return address borne by the enclosure is visible through the window. These procedures are complex, detracting from the usefulness and acceptability of the two-way envelope design.

U.S. Pat. No. 2,931,559 describes a remailable billing envelope with a resealing flap on which is printed the return address. The resealing flap is connected to the back panel along a common back top edge of the envelope. For original mailing, the resealing flap is folded at the back top edge and stuffed within the envelope pocket. The envelope is thus mailed in its unsealed condition, providing no privacy or capability for enclosure information or materials. Additionally, upon receipt by the addressee, the resealing flap is vulnerable to being cut during opening of the original envelope. The potential uses of such an envelope are thus limited.

U.S. Pat. No. 3,874,582 provides a two-way envelope comprising a front panel with a window, a bottom flap, two opposed side flaps with detachable upper portions and a detachable top flap. Upon receiving the envelope, the original addressee removes the three detachable portions from the envelope to form a smaller sized return envelope with a newly formed top resealing flap. For return mailing, the original addressee inserts a response into the envelope pocket, inserts an enclosure containing the return address so that the return address can be seen through the window, and then folds and seals the newly formed top resealing flap to the back panel. Again, the complexity of transforming the original envelope into a usable return envelope detracts from the usefulness and acceptability of the two-way envelope design.

U.S. Pat. No. 3,982,689 illustrates another two-way mailing envelope, including a window and an enclosure to be transmitted therein. The envelope is usable for return mailing by tearing a top flap from the front panel of the envelope and thereby exposing a resealing flap which, being the upper portion of the back panel, is then folded toward and attached to the front panel. Thus, the remailing envelope is smaller than the original envelope by the length of the top flap which is removed by the original addressee for envelope opening. Thus the envelope also requires an enclosure with two address areas for exposure through the window. Additionally, opening the envelope without removing the tearable top flap will not properly expose the resealing flap for folding and securing to the front panel for remailing. The foregoing complexities of operation, including modification of the enclosure bearing the return address, detract from the usefulness and acceptability of this envelope design.

U.S. Pat. No. 4,089,418 describes a returnable envelope consisting of a blank having a main panel and flaps foldable from each edge. For original mailing, the envelope is formed by inwardly folding two opposed side flaps, by upwardly folding a bottom flap, and by downwardly folding a top panel. The top panel is then temporarily adhered to the outer surface of the bottom flap. For return mailing, the original addressee detaches the top panel from the back of the envelope without tearing the envelope, unfolds the envelope completely and then refolds the envelope into a different configuration for return mailing. Additionally, opening the envelope can sever the top panel from the main panel and destroy the envelope's designed remailability. These disadvantages, again, detract from usefulness and acceptability.

From the foregoing considerations, it should be apparent that there is a great need for a remailable envelope which may be manufactured, stuffed and mailed by high speed automatic machines, which can be opened by automatic or manual envelope opening devices without destroying remailability, and which is simple in use for original mailing and remailing. The subject invention is directed to just such an envelope.

SUMMARY OF THE INVENTION

The subject invention relates to a novel remailable envelope formed from a blank which is symmetrical about its center line. The blank consists of a top flap with tear strip; a front panel which is foldably connected to the top flap, a pair of opposed side flaps and a back panel; and a resealing flap foldably connected to the back top edge of the back panel. The front panel may contain a viewing window and the resealing flap may cover the optional window when the flap is folded and sealed to the front panel. Being symmetrical about its center line, the envelope blank readily may be cut, printed, folded, and formed into an envelope in "web-type" automatic envelope making machines.

In preparation for original mailing, the envelope blank is folded so that the common edge between the resealing flap and the back panel is at an appropriate spacing below the top edge of the front panel when the back panel is folded to overlie the front panel. The allowance of this spacing enables any enclosures to automatically be inserted into the envelope by automatic insertion machines.

Prior to original mailing, the top flap is adhesively sealed to the back panel of the envelope providing security and privacy in mailing. In one embodiment, the envelope is received by the original addressee and is opened by removing the tear strip from the top flap or by opening the envelope along its top edge by conventional automatic or by manual opening devices. The spacing referred to above also protects the resealing flap from inadvertently being severed from the back panel if the envelope opened with automatic or manual opening devices. In another embodiment, the envelope is opened by removing a tear strip located on the front panel or by opening the envelope along its top edge by manual or automatic opening devices as noted above. The original addressee removes any contents of the envelope, pulls the resealing flap from the envelope folds, and inserts what is to be remailed within the envelope pocket. In one embodiment, the original addressee folds and secures the resealing flap over the front panel or window thereby exposing for mailing the return address borne by the outer side of the resealing flap. In another embodiment, the original addressee folds and secures to the front panel a shorter resealing flap which does not cover the entire viewing window. In all embodiments, placing the envelope in its remailing configuration does not require complex manipulation, and does not reduce the length or the width of the envelope as originally mailed.

It is, thus, an object of the present invention to provide a remailable envelope which may be manufactured, stuffed and sealed on high speed automatic envelope making and insertion machines.

Another object of the present invention is to provide a remailable envelope which is simple in operation.

A further object of the present invention is to provide a remailable envelope which may sealed prior to original mailing for security and privacy, and to enable the enclosure of information or materials.

It is a further object of the present invention to provide a remailable envelope which may be opened with automatic or manual envelope opening devices without destroying the remailability of the envelope.

Still another object of the present invention is to provide a remailable envelope which does not require the use of a viewing window and a properly printed and inserted addressing enclosure.

Other objects and advantages of this invention will further become apparent hereinafter and with reference to the accompanying drawings.

BRIEF DESCRIPTION OF THE DRAWINGS

FIG. 1 is a plan view of the inner face of the remailing envelope blank in its completely unfolded form showing an optional viewing window.

FIG. 2 is a rear view of the remailable envelope in its partially folded form prior to folding and sealing the top flap for first mailing.

FIG. 3 is a rear view of the remailable envelope in its completely folded form for first mailing.

FIG. 4 is a front view of the remailable envelope in its completely folded form for first mailing, showing the optional viewing window.

FIG. 5 is an enlarged section taken along line 5—5 of FIG. 4.

FIG. 6 is a front view of the remailable envelope in its completely folding form for second mailing.

FIG. 7 is an enlarged section taken along line 7—7 of FIG. 6.

FIG. 8 is a front view of another embodiment of the remailable envelope in its completely folded form for second mailing, showing the optional viewing window.

DESCRIPTION OF THE PREFERRED EMBODIMENTS

Figure 9:
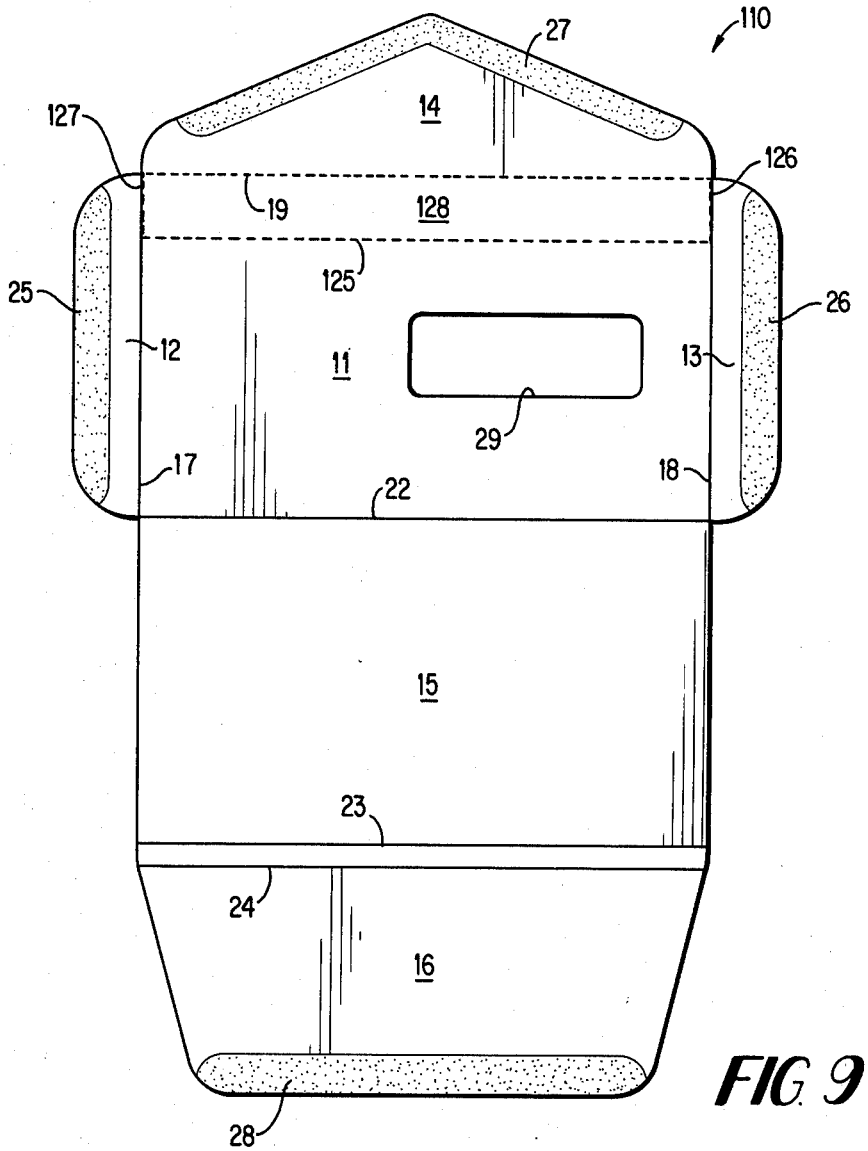
FIG. 9 is a plan view of the inner face of another embodiment of the remailable envelope blank similar to the blank shown in FIG. 1 except that the tear strip is located on the front panel.

The subject invention will now be described with reference to the drawings, in which FIG. 1 illustrates an envelope blank made from paper or other suitable material and generally designated by the numeral 10. Envelope blank 10 includes a front panel 11, a pair of opposed foldable side flaps 12 and 13, a top flap 14, a back panel 15, and a resealing flap 16. The side flaps 12 and 13 are integrally connected to the front panel 11 along fold lines 17 and 18, respectively. The top flap 14 is integrally connected to the top edge of the front panel 11 along tear line 19. Tear line 19 comprises, for example, a line of perforations. A second tear line 20 is provided on the top flap 14 to define, in conjunction with tear line 19, a tear strip 21.

The front panel 11 and the back panel 15 are integrally connected along a common bottom edge 22. The resealing flap 16 is integrally connected to the back panel 15 along fold line 23, and is provided with a second fold line 24. Envelope blank 10 contains adhesive strips 25, 26, 27 and 28 which are applied to the side flap 12, the side flap 13, the top flap 14 and the resealing flap 16, respectively. The front panel 11 may be provided with one or more viewing windows 29 spaced above the bottom edge 22 of the front panel 11. As illustrated in FIG. 6, the outer face of resealing flap 16 bears indicia of the return address.

The formed envelope generally designated by the number 30 in FIGS. 3 and 4, is assembled from the blank 10 previously described when reference was made to FIG. 1. As shown, for example, in FIG. 4, the envelope blank may contain printed or written indicia as desired for usage instructions, addresses, permit postage information, or the like.

The original addressee may have usage instructions sequentially presented where the instructions are provided, in part, on the tear strip 21 for viewing prior to removal of the tear strip 21 and, in part, on the upper portion of the back panel 15 for viewing after removal of the tear strip 21.

Formation of the envelope 30 from envelope blank 10 takes place as follows. The resealing flap 16, shown in FIG. 1, is folded along fold line 23 so that the resealing flap 16 overlies a portion of the inner face of back panel 15. The back panel 15 is then folded along the bottom edge 22 to overlie a portion of the inner face of front panel 11. The portion of the inner face of front panel 11 which is not covered by back panel 15 is a thin strip, on the order of one-eighth inch in width, along the top edge of the front panel 11. The thin strip is shown in FIG. 2 as that portion of the inner face of the front panel 11 exposed between the tear line 19 and the fold line 23. The side flaps 12 and 13 are then folded along fold lines 17 and 18, respectively, and secured by adhesive strips 25 and 26, respectively, to the outer face of the back panel 15, thereby providing an envelope pocket with an open end portion between fold line 23 and the tear line 19 as shown in FIG. 2.

For first mailing, an enclosure 31, sectionally illustrated in FIG. 5, may be inserted within the envelope pocket open end and sealed therein by folding the top flap 14 along tear line 19 to overlie a portion of the side flaps 12 and 13 and the back panel 15 as shown in FIG. 3. The top flap 14 is secured by adhesive strip 27 to portions of the outer faces of the side flaps 12 and 13 and the back panel 15. The address of the original addressee, borne by the enclosure 31 is visible through the viewing window 29 in the front panel 11 as shown in FIG. 4. As noted, the window 29 is optional; if none is provided, the address of the original addressee can be written, typed, or placed on the envelope front by an address strip.

Upon receipt, the original addressee opens the envelope by tearing along tear lines 19 and 20, thus removing the tear strip 21 and exposing the contents of the envelope. The original addressee may also open the envelope along its top edge by using automatic or manual envelope opening devices without danger of inadvertently severing the resealing flap 16 from the back panel 15.

The original addressee then removes the contents of the envelope, including enclosure 31 (unless enclosure 31 is needed for return to the sender or for display of a return address or other information through window 29), and pulls the resealing flap 16 from within the envelope pocket. For second mailing, an appropriate response, such as enclosure 32, sectionally illustrated in FIG. 7, is inserted within the envelope pocket and sealed therein by folding the resealing flap 16 along fold line 24 to overlie a portion of the outer face of the front panel 11 as shown in FIG. 6. The resealing flap is secured by adhesive 28 to a portion of the front panel 11. With proper postage placed on the outer face of the resealing flap 16, the envelope is ready for return mailing to the original sender at the return address borne by the resealing flap 16. The return address may be placed on the resealing flap by preprinting, by affixing an address label thereon, by writing, or by other suitable methods.

In another preferred embodiment, the front panel is plain, without one or more viewing windows. The address of the original addressee may in this embodiment be placed on the front panel 11, as modified, by preprinting, by fixing an original address label thereon, by writing, or by other suitable methods.

In yet another preferred embodiment, the remailable envelope utilizes a resealing flap of sufficiently shortened length so that one or more viewing windows provided in the front panel are exposed when the envelope is in its remailing configuration. This embodiment is illustrated in FIG 8, in which the resealing flap 50 is a shortened version of the resealing flap 16. The viewing window 51 corresponds to the window 29 of FIG. 1, and the front panel 52 corresponds to the front panel 11.

Figure 10:
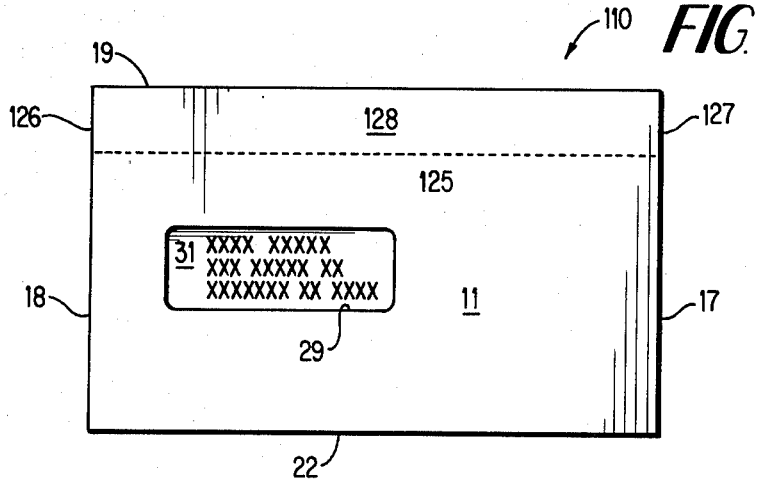
FIG. 10 is a front view of the remailable envelope shown in FIG. 9 in its completely folded form for first mailing, showing the optional viewing window.

In still another embodiment, the remailable envelope utilizes a tear strip in the front panel instead of in the top flap. This embodiment is illustrated in FIGS. 9 and 10 which are similar to FIGS. 1 and 4, respectively, wherein like numbered elements are the same and wherein the tear strip 128 is defined by tear lines 19, 125, 126 and 127. In this embodiment, usage instructions may be provided, in part, the tear strip 128 for viewing prior to the tear strip 128's removal and, in part, on the upper portion of the resealing flap 16 for viewing after removal of the tear strip 128.

Obviously, many modifications and variations of the present invention are possible in light of the above teachings. For example, it is contemplated that the panel and flaps of the remailable envelope may be of different design and arrangement, that the envelope may or may not contain written or printed indicia, and that the envelope may be provided with additional viewing windows. It is, therefore, to be understood that within the scope of the appended claims, the invention may be practiced otherwise than as specifically described.

What is claimed is:

1. An envelope formed from an envelope blank which is symmetrical about its center line, said envelope comprising a front panel having a top edge, a bottom edge and two side edges; a pair of opposed side flaps, each of which is integrally connected to said front panel at first fold lines along one of said front panel side edges; a back panel integrally connected to said front panel bottom edge at a second fold line and having a top edge and two side edges; a resealing flap integrally connected to said back panel top edge at a third fold line; a top flap integrally connected to said front panel top edge at a fourth fold line; first adhesive means for securing said side flaps in overlying relation to said back panel folded along said front panel bottom edge to overlie a portion of the inner face of said front panel; second adhesive means for securing said top flap in overlying relation to the outer face of said back panel to seal the envelope for first mailing; and third adhesive means for securing said resealing flap in overlying relation to the outer face of said front panel to seal the envelope for second mailing.

2. The envelope according to claim 1, wherein at least one viewing window having a top edge and a bottom edge is provided in said front panel, spaced above said front panel bottom edge.

3. The envelope according to claim 1, further provided with at least one fold line in said resealing flap in addition to said third fold line in said resealing flap.

4. The envelope according to claim 1, wherein the length of each said front panel side edges is one-eighth inch greater than the length of each said back panel side edges.

5. The envelope according to claim 1, further provided with a first tear line, a second tear line and a tear strip wherein said top flap contains across the width of said top flap said tear strip defined by said first tear line and said second tear line.

6. The envelope according to claim 1, further provided with a first tear line, a second tear line, a third tear line, a fourth tear line and a tear strip wherein said front panel contains across the width of said front panel said tear strip defined by said first tear line, second tear line, third tear line, and fourth tear line.

7. The envelope according to claim 1, wherein said second adhesive means secures said top flap in overlying relation to the outerfaces of said side flaps to seal the envelope for first mailing.

8. The envelope according to claim 2, wherein said resealing flap overlies said viewing window when folded and secured to said front panel.

9. The envelope according to claim 2, wherein the length of said resealing flap is less than the distance between said front panel top edge and said viewing window bottom edge whereby at least a portion of said viewing window remains exposed when said resealing flap and is folded secured to said front panel.

10. The envelope according to claim 2, wherein the length of said resealing flap is less than the distance between said front panel top edge and said viewing window top edge whereby said viewing window remains exposed when said resealing flap is folded and secured to said front panel.

11. The envelope according to claim 3, wherein said additional fold line is spaced one-eighth inch from said third fold line.

12. The envelope according to claim 1, further provided with indicia of a return mailing address wherein said resealing flap bears said indicia on its outer face.

13. The envelope according to claim 1, further provided with indicia of instructions for envelope use including an octagonal shaped figure containing the word "READ" wherein said back panel bears said indicia in order to obtain the attention of the original addressee.

14. The envelope according to claim 5, further provided with a first indicia of instructions for envelope use and a second indicia of instructions for envelope use wherein said tear strip bears on its outer face said first indicia and said back panel bears said second indicia, said second indicia being positioned on said back panel so that it is viewable by the original addressee upon removal of said tear strip thus providing sequential instructions.

15. The envelope according to claim 6, further provided with a first indicia of instructions for envelope use and a second indicia of instructions for envelope use wherein said tear strip bears on its outer face said first indicia and said resealing flap bears said second indicia, said second indicia being positioned on said resealing flap so that it is viewable by the original addressee upon removal of said tear strip thus providing sequential instructions.

16. A method for making an envelope formed from an envelope blank which is symmetrical about its center line and which comprises a front panel having a top edge, a bottom edge and two side edges; a pair of opposed side flaps, each of which is integrally connected to said front panel at first fold lines along one of said front panel side edges; a back panel integrally connected to said front panel bottom edge at a second fold line and having a top edge and two side edges; a resealing flap integrally connected to said back panel top edge at a third fold line; a top flap integrally connected to said front panel top edge at a fourth fold line; first adhesive means for securing said side flaps in overlying relation to said back panel folded along said front panel bottom edge to overlay a portion of the innerface of said front panel; second adhesive means for securing said top flap in overlying relation to the outer face of said back panel to seal the envelope for first mailing; and third adhesive means for securing said resealing flap in overlying relation to the outer face of said front panel to seal the envelope for second mailing; the method comprising the steps of: folding said resealing flap along said third fold line to overlie a portion of the inner face of said back panel; folding said back panel along said second fold line to overlie the inner face of said front panel; and folding and securing by said first adhesive means said side flaps in overlying relation to said back panel.

* * * * *

Disclaimer 4,308,987.—*Merrill Solomon,* Potomac, Md. REMAILABLE ENVELOPE. Patent dated Jan. 5, 1982. Disclaimer filed Mar. 16, 1984, by the assignee, *21st Century Envelope Co., Inc.*

Hereby enters this disclaimer to claims 1, 2, 4, 5, 7, 8, 9, 10 and 16 of said patent.

[*Official Gazette May 15, 1984.*]